US005848561A

United States Patent [19]

Hsieh

[11] Patent Number: 5,848,561

[45] Date of Patent: Dec. 15, 1998

[54] RATCHET SOCKET WRENCH AND SOCKET ARRANGEMENT

[76] Inventor: Chih-Ching Hsieh, No. 64, Lane 107, Liang Tsun Rd., Fong Yuan City, Taichung Hsien, Taiwan

[21] Appl. No.: 744,584

[22] Filed: Nov. 6, 1996

[51] Int. Cl.[6] ..... B25B 13/00

[52] U.S. Cl. ..... 81/59.1; 81/125

[58] Field of Search ..... 81/59.1, 60, 61, 81/62, 63, 63.1, 63.2, 125; 192/45

[56] References Cited

U.S. PATENT DOCUMENTS

| | | | |
|---|---|---|---|
| 1,609,086 | 11/1926 | Hurschman | 81/59.1 |
| 2,699,082 | 1/1955 | Viets | 81/59.1 |
| 4,259,883 | 4/1981 | Carlson | 81/60 X |
| 5,233,891 | 8/1993 | Arnold et al. | 81/60 |

*Primary Examiner*—James G. Smith
*Assistant Examiner*—Benjamin M. Halpern
*Attorney, Agent, or Firm*—Varndell Legal Group

[57] ABSTRACT

A ratchet socket wrench and socket arrangement including a socket having a hexagonal coupling end, and a ratchet socket wrench having a box at one end and ratchet wheel mounted in the box and adapted for turning the socket, the ratchet wheel having a locating element supported on a spring in a radial hole thereof and forced by the spring into engagment with one recessed locating hole at one side of the hexagonal coupling end to stop the socket from rotary motion relative to the ratchet wheel, and a plurality of needle rollers moved in spaces in sloping teeth thereof to limit the rotary motion of the ratchet wheel to one direction within the box of the ratchet socket wrench.

1 Claim, 5 Drawing Sheets

RATCHET SOCKET WRENCH AND SOCKET ARRANGEMENT

BACKGROUND AND SUMMARY OF THE INVENTION

The present invention relates to a ratchet socket wrench and socket arrangement and relates, more particularly, to an arrangement in which the ratchet wheel has a radially disposed locating element supported on a spring and forced by the spring into engagement with one recessed hole at one peripheral side of the socket. In order to stop the socket from rotary motion relative to the ratchet wheel, needle rollers are mounted in spaces in the teeth of the ratchet wheel to limit the rotary motion of the ratchet wheel to one direction within the box of the ratchet socket wrench.

FIG. 1 shows a ratchet socket wrench and socket arrangement according to the prior art, in which the socket has a polygonal coupling end peripherally mounted with a rubber damping ring and adapted for coupling to the center coupling hole of the ratchet wheel at one end of the ratchet socket wrench. The main drawback of this ratchet socket wrench and socket arrangement is that the rubber damping ring wears quickly with use. When the rubber damping ring starts to wear, the socket may fall out of the coupling hole of the ratchet wheel during the operation. FIG. 2 shows another ratchet socket wrench and socket arrangement according to the prior art, in which the ratchet wheel of the ratchet socket wrench has a polygonal coupling tube raised from one side, and a retention spring projecting out of an elongated slot in the polygonal coupling tube and adapted for securing the socket to the polygonal coupling tube upon its loading. This arrangement is not durable in use because the spring power of the retention spring gradually disappears with use.

The present invention has been accomplished to provide a ratchet socket wrench and socket arrangement which eliminates the aforesaid problems. According to one aspect of the present invention, the ratchet socket wrench and socket arrangement comprises a socket having a hexagonal coupling end, and a ratchet socket wrench having a box at one end and a ratchet wheel mounted in the box and adapted for turning the socket, wherein the ratchet wheel comprises a locating element supported on a spring in a radial hole thereof and forced by the spring into engagement with one recessed locating hole at one side of the hexagonal coupling end to stop the socket from rotary motion relative to the ratchet wheel. According to another aspect of the present invention, a plurality of needle rollers are moved in spaces in the sloping teeth of the ratchet wheel within the box of the ratchet socket wrench to limit the rotary motion of the ratchet wheel within the box to one direction.

DETAILED DESCRIPTION OF THE PREFERRED EMBODIMENT

Figure 1:
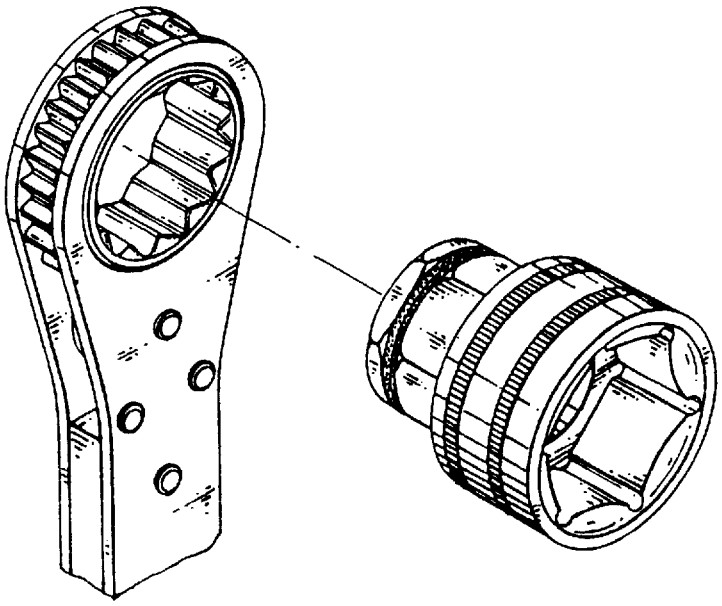
Fig . 1 PRIOR ART
FIG. 1 shows a ratchet socket wrench and socket arrangement according to the prior art.
Figure 2:
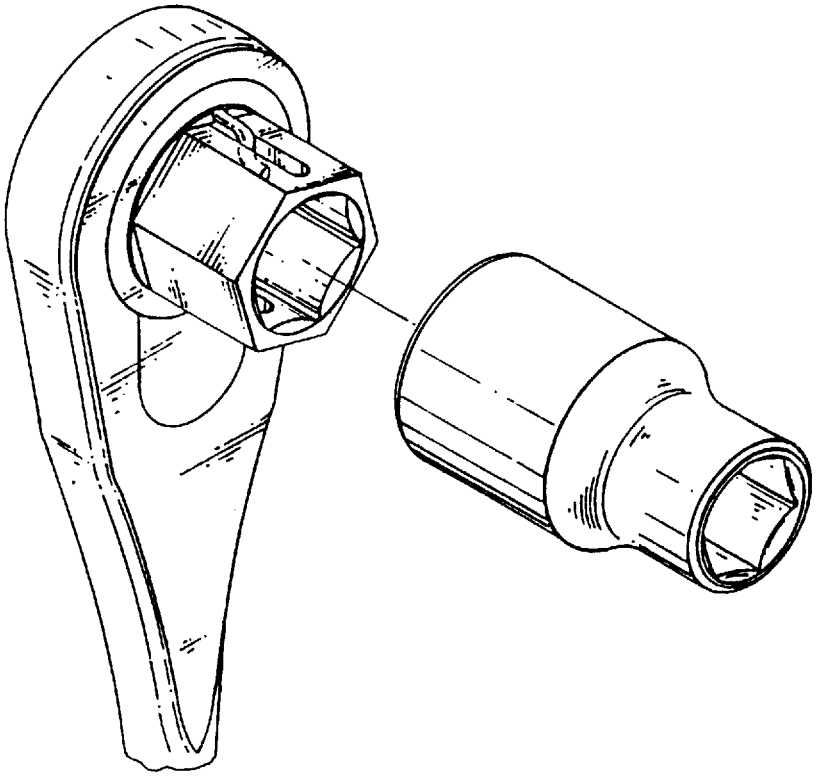
Fig. 2 PRIOR ART
FIG. 2 shows another ratchet socket wrench and socket arrangement according to the prior art.
Figure 3:
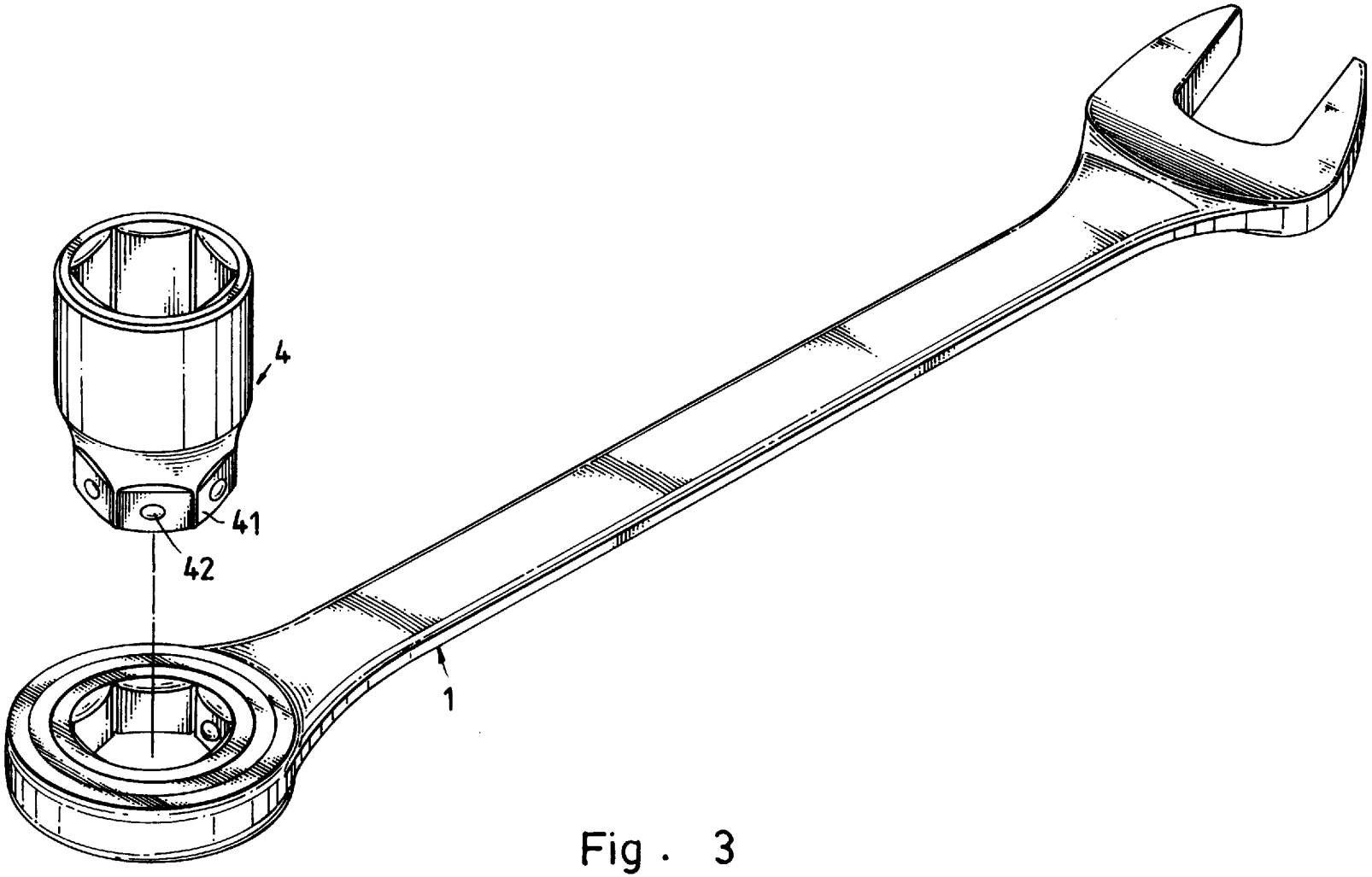
FIG. 3 shows a ratchet socket wrench and socket arrangement according to the present invention.
Figure 4:
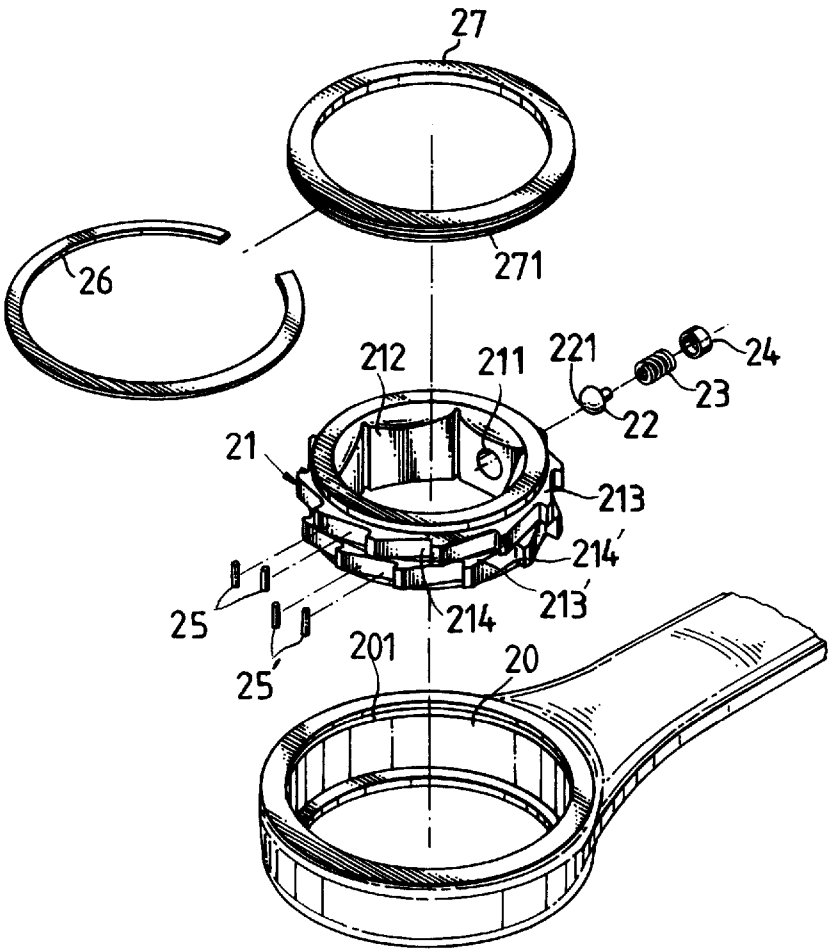
FIG. 4 is an exploded view of a ratchet socket wrench and socket arrangement according to the present invention.
Figure 5:
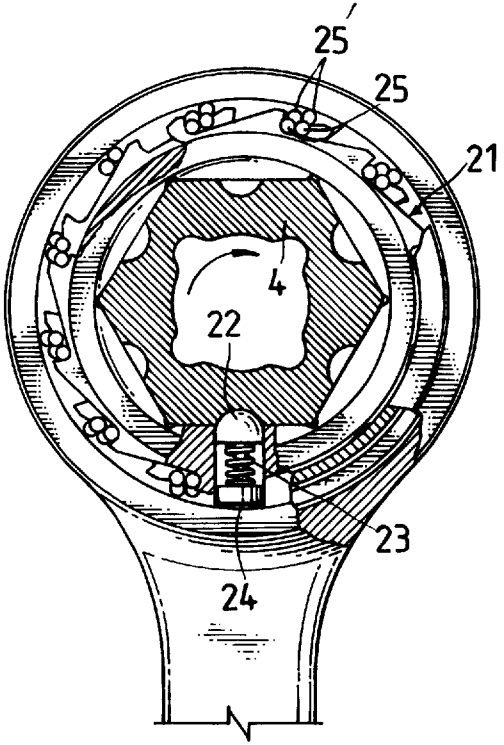
FIG. 5 is a sectional view of the present invention, showing the socket and the ratchet wheel turned in idle within the box.

Referring to FIGS. 3, 4, and 5, the present invention is comprised of a ratchet socket wrench 1, and a socket 4. The ratchet socket wrench 1 has a circular box 20 at one end, and a locating groove 201 within the box 20. A ratchet wheel 21 is mounted within the box 20, and secured in place by an O-ring 27 and a C-shaped clamping spring 26. The O-ring 27 has a locating groove 271 around the periphery. The C-shaped clamping spring 26 is mounted around the locating groove 271 of the O-ring 27 and then press-fit into the locating groove 201 of the box 20 to secure the ratchet wheel 21 in the box 20 firmly.

Referring to FIGS. 4 and 5, the ratchet wheel 21 comprises a hexagonal coupling hole 212 through the axial center adapted for receiving the socket 4, a radial through hole 211 in communication with the hexagonal coupling hole 212, a plug cap 24 fastened to the radial through hole 211 at an outer end, a compression spring 23 mounted in the radial through hole 211 and connected to the plug cap 24, a locating element 22 connected to one end of the compression spring 23 remote from the plug cap 24 and having a rounded front end 221 forced by the compression spring 23 into the hexagonal coupling hole 212, a plurality of first teeth 213 raised around the periphery near the top side and slopped in one direction and spaced from one another by a plurality of first peripheral spaces 214, a plurality of second teeth 213' raised around the periphery near the bottom side and slopped in the same direction of the first teeth 213 and spaced from one another by a plurality of second peripheral spaces 214', a plurality of first needle rollers 25 respectively moved in the first peripheral spaces 214, and a plurality of second needle rollers 25' respectively moved in the second peripheral spaces 214'. The first teeth 213 and the second teeth 213' are staggered, that is, the first teeth 213 are respectively aligned with the second peripheral spaces 214'; the first peripheral spaces 214 are respectively aligned with the second teeth 213'.

Referring to FIGS. 3 and 5, the socket 4 comprises a hexagonal coupling end 41 having six angles and six sides adapted for fitting into the hexagonal coupling hole 212 of the ratchet wheel 21, and six recessed locating holes 42 respectively disposed at the center of the six sides of the hexagonal coupling end 41. When the hexagonal coupling end 41 of the socket 4 is fitted into the hexagonal coupling hole 212 of the ratchet wheel 21, the rounded front end 221 of the locating element 22 of the ratchet wheel 21 is forced by the compression spring 23 into engagement with one recessed locating hole 42 of the hexagonal coupling end 41 of the socket 4, and therefore the socket 4 is secured to the ratchet wheel 21.

Figure 6:
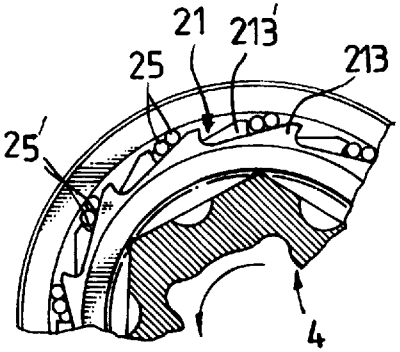
FIG. 6 is another sectional view of the present invention, showing the needle rollers engaged between the ratchet wheel and the box.

Referring to FIGS. 5 and 6, when the socket 4 is coupled to the ratchet wheel 21 and turned in one direction (the arrowhead direction shown in FIG. 5), the needle rollers 25, 25' are turned in the spaces 214, 214' and moved away from the inside wall of the box 20, therefore the ratchet wheel 21 is turned with the socket 4 within the box 20 clockwise in idle; when the socket 4 is turned in the reversed direction (the arrowhead direction shown in FIG. 6), the needle rollers 25, 25' are moved outwards into engagement with the inside wall of the box 20, therefore the ratchet wheel 21 and the socket 4 are stopped from rotary motion relative to the box 20, that is, the socket 4 and the ratchet wheel 21 can be turned with the box 20 of the ratchet socket wrench 1 to turn a hexagon head bolt, hexagon nut, etc.

I claim:

1. A ratchet socket wrench and socket arrangement comprising a socket having a polygonal coupling end and a ratchet wrench including an elongated casing having a box end with a circular opening, and a ratchet wheel mounted in said circular opening, said ratchet wheel including a cylindrical wall having an inner peripheral side and an outer peripheral side, said inner peripheral side defining a polygonal coupling hole adapted for releasably holding said polygonal coupling end of said socket for turning a hexagon head bolt or hexagon nut, said polygonal coupling end of said socket having a plurality of recessed locating holes equally spaced about an outer peripheral wall thereof, and said ratchet wheel further including a radial hole extending through said cylindrical wall in a radial direction and into said polygonal coupling hole, a compression spring mounted in said radial hole, a plug cap fastened to said radial hole to hold said compression spring in place, and a locating member supported on said compression spring in said radial hole and having a rounded head forced by said compression spring into said polygonal coupling hole for engagement with one of said recessed locating holes for coupling said socket to said ratchet socket wrench and inhibiting rotation of said socket relative to said ratchet wheel, wherein said ratchet wheel has first and second rows of teeth arranged about said outer peripheral wall of said ratchet wheel, said teeth respectively having a lower portion and a higher portion relative to an axial direction of said ratchet wheel and a flat and straight sloping surface extending from said lower portion to said higher portion, said flat and straight and sloping surfaces all sloping in a same direction, said first row of teeth are adjacent said second row of teeth, and said first row of teeth are staggered relative to said second row of teeth in that said higher portions of said first row of teeth are respectively arranged between said higher and lower portions of said second row of teeth, and two needle rollers are respectively arranged between said lower and higher portions of said teeth, said needle rollers and said teeth are arranged without the use of springs to permit rotation of said ratchet wheel in a first direction and to inhibit rotation of said rachet wheel in a direction opposite of said first direction by said needle rollers respective abutting said flat and sloping surface of said teeth and a surface of said circular opening.

* * * * *